US007189170B1

(12) United States Patent
Korsa et al.

(10) Patent No.: US 7,189,170 B1
(45) Date of Patent: Mar. 13, 2007

(54) ARROW NOCK

(76) Inventors: Stephen P. Korsa, 4343 Warbler Dr., Fort Collins, CO (US) 80524; Alan S. Korsa, 12994 W. 80th Ave., Arvada, CO (US) 80005

( * ) Notice: Subject to any disclaimer, the term of this patent is extended or adjusted under 35 U.S.C. 154(b) by 59 days.

(21) Appl. No.: 10/907,011

(22) Filed: Mar. 16, 2005

(51) Int. Cl.
*F42B 6/06* (2006.01)

(52) U.S. Cl. ..... 473/578

(58) Field of Classification Search ..... 473/578, 473/585, 586; 124/35.2, 91
See application file for complete search history.

(56) References Cited

U.S. PATENT DOCUMENTS 1,542,762 A * 6/1925 Cole ..... 473/578
1,785,589 A 12/1930 Mead
2,245,187 A * 6/1941 Donash ..... 473/578
3,034,789 A 5/1962 Moore
3,214,174 A * 10/1965 Saunders ..... 473/578
3,586,332 A 6/1971 Alban
4,134,369 A 1/1979 Cook
4,151,825 A 5/1979 Cook
4,574,767 A * 3/1986 Gazzara ..... 124/35.2
4,645,211 A 2/1987 Beiter
RE34,126 E * 11/1992 Todd ..... 124/35.2
5,582,158 A * 12/1996 Linsmeyer ..... 124/35.2
6,123,631 A * 9/2000 Ginder ..... 473/570
6,213,114 B1 * 4/2001 Burkhart ..... 124/91
6,364,499 B1 * 4/2002 Jones ..... 362/109

* cited by examiner

*Primary Examiner*—John A. Ricci
(74) *Attorney, Agent, or Firm*—Ancel W. Lewis, Jr.

(57) ABSTRACT

An arrow nock has a nock body, an actuator and a pair of retaining tabs. The retaining tabs retain the bowstring in the arrow nock while the bowstring is drawn. When the bowstring is released, the bowstring moves the actuator to a forward position and the actuator moves the retaining tabs to an open position so that the bowstring clears the arrow nock without friction.

7 Claims, 3 Drawing Sheets

ARROW NOCK

TECHNICAL FIELD

The present invention relates to archery equipment, and more particularly to an arrow nock that retains an arrow on the bowstring until the arrow is shot.

BACKGROUND ART

An arrow nock forms the rearward end of an arrow and generally has a pair of wings that form a notch for receiving the bowstring. An arrow nock without a notch is disclosed in U.S. Pat. No. 1,785,589 to Mead. The arrow nock is often made as a separate component that is affixed to the rearward end of the arrow shaft.

Arrow nocks with a notch having parallel sides or sides that diverge rearwardly can slip off of the bowstring as the bow is drawn. Many known arrow nocks have notches with sides that converge rearwardly to retain the nock on the bowstring. However, the rearwardly converging sides create frictional drag on the arrow during release from the bowstring.

U.S. Pat. No. 1,542,762 to Cole discloses an arrow nock where one of the wings is spring biased and pivots to accommodate different bowstring diameters. U.S. Pat. No. 3,034,789 to Moore discloses an arrow nock with a leaf spring to retain the arrow on the bowstring. U.S. Pat. No. 3,214,174 to Saunders discloses an arrow nock with a cavity forward of the notch that allows the wings to flex outwardly more easily during engagement and release of the bowstring. None of these arrow nocks eliminates frictional drag during release.

DISCLOSURE OF THE INVENTION

An arrow nock includes a nock body, a pair of retaining tabs, an actuator and a means for biasing the actuator rearwardly. The nock body has forward portion that affixes to the tail of an arrow, an intermediate portion and a pair of spaced wings that extend rearwardly from the intermediate portion. The actuator fits between the wings and is movable between rearward and forward positions. The retaining tabs are movable between a closed position and an open position, and are linked to the actuator such that when the actuator moves from the rearward position to the forward position, the retaining tabs move from the closed position to the open position. The retaining tabs retain the bowstring when in the closed position and clear the bowstring when in the open position. When the bowstring is released to shoot the arrow, the bowstring pushes the actuator to the forward position. The means for biasing is selected such that the retaining tabs remain in the open position until after the bowstring clears the arrow nock.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
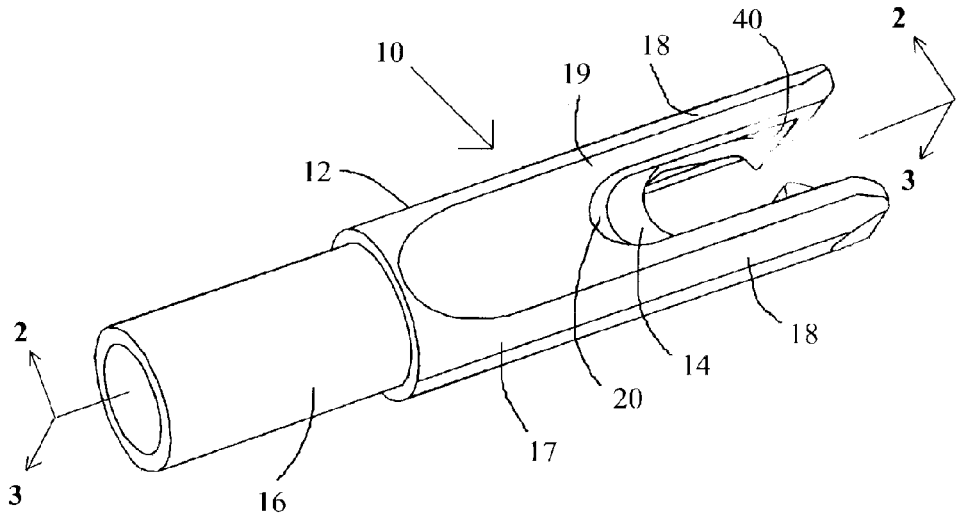
FIG. 1 is a perspective view of an arrow nock embodying features of the present invention.
Figure 2:
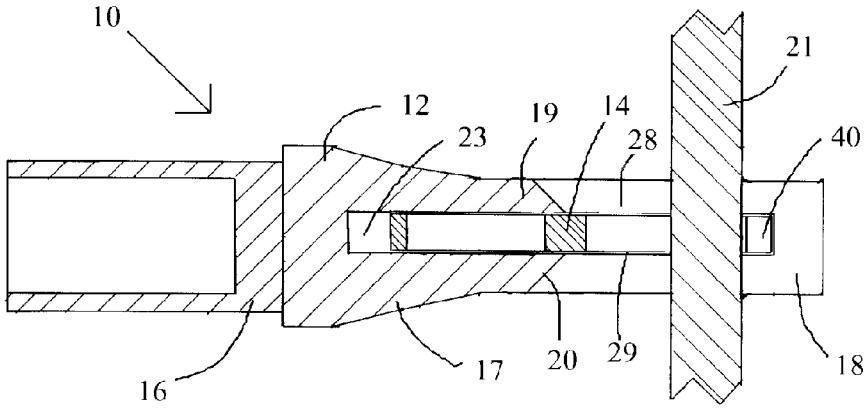
FIG. 2 is a cross sectional view of the arrow nock of FIG. 1 taken along line 2—2.

Referring now to FIGS. 1 to 4, an arrow nock 10 embodying features of the present invention includes a nock body 12 and an actuator 14. The nock body 10 has a forward portion 16, an intermediate portion 17 and two wings 18. The forward portion 16 is sized and shaped to affix to the tail end of an arrow. The intermediate portion 17 extends rearwardly from the forward portion 16 to a back end 19. The wings 18 are spaced apart and extend substantially parallel from opposite sides of the back end 19 of the intermediate portion 17, forming, in combination with the back end 19, a U shaped body notch 20. The body notch 20 is sized to receive a bowstring 21 with the spacing between the wings 18 being greater than the diameter of the bowstring 21.

Describing the specific embodiments herein chosen for illustrating the invention, certain terminology is used which will be recognized as being employed for convenience and having no limiting significance. For example, the terms "forward", and "rearward" refer to the illustrated embodiment in its normal position of use, affixed to an arrow and nocked onto a substantially vertical section of a bowstring. The terms "outward" and "inward" refer to lateral directions with reference to the axis of the device. Further, all of the terminology above-defined includes derivatives of the word specifically mentioned and words of similar import.

Figure 3:
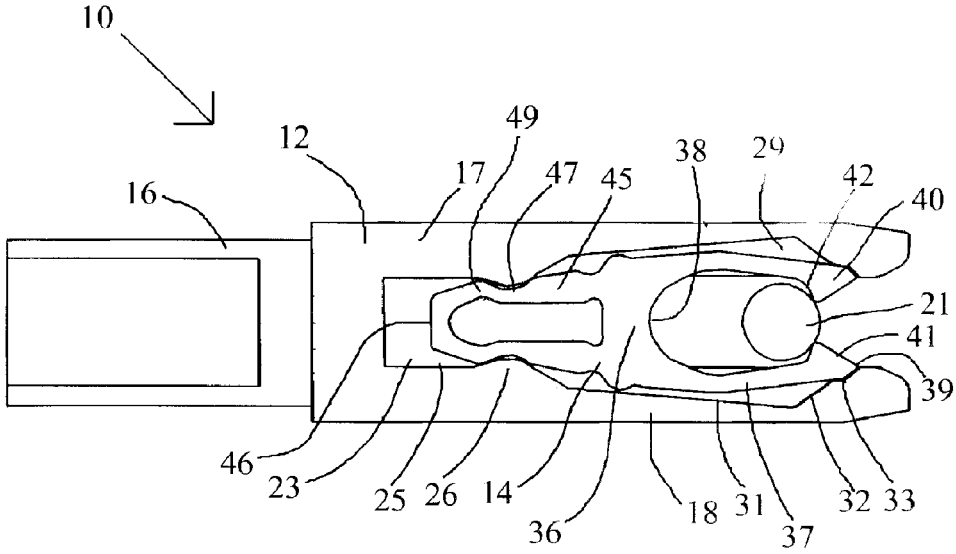
FIG. 3 is a cross sectional view of the arrow nock of FIG. 1 taken along line 3—3, with the actuator in the rearward position.
Figure 4:
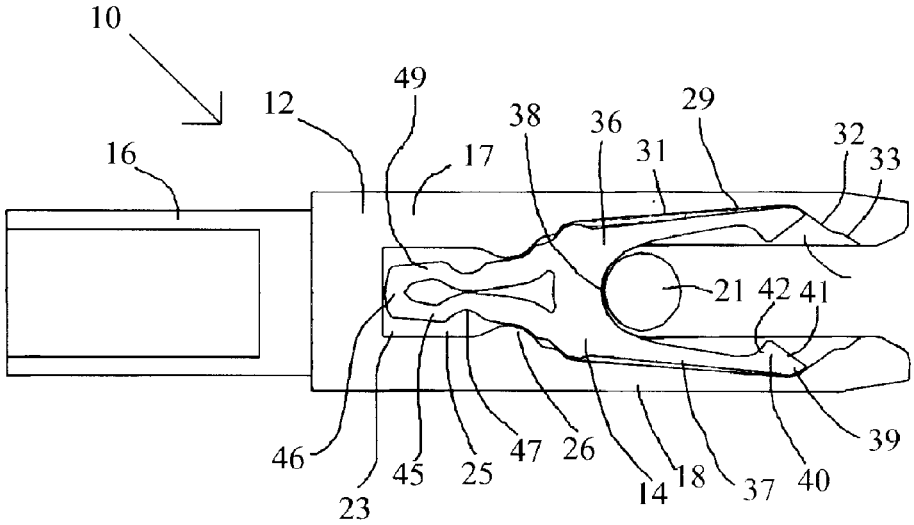
FIG. 4 is a cross sectional view of the arrow nock of FIG. 1 taken along line 3—3, with the actuator in the forward position.

The intermediate portion 17 of the nock body 12 has an interior cavity 23. The interior cavity 23 has a substantially uniform height, as shown in FIG. 3. Referring to FIG. 4, the interior cavity 23 has a shaped horizontal cross section including a rectangular front section 25 bounded at the back end by a pair of spaced, opposed, inwardly projecting, rounded protrusions 26. The interior cavity 23 diverges outwardly, rearwardly from the protrusions 26.

The wings 18 each have an inner surface 28, and an inwardly opening groove 29 recessed into the inner surface 28 and connected to the interior cavity 23. The grooves 29 are the same height as the interior cavity 23. Each groove 29 has a forward section 31 that angles outwardly and rearwardly from the interior cavity 23 and a rearward section 32 that angles inwardly and rearwardly from the forward section 31. The length of the forward section 31 is much greater than the length of the rearward section 32 and the angle of the rearward section 32 is much greater than the angle of the forward section 31. A concave dimple 33 connects the rearward end of the rearward section 32 to the inner surface 28.

The actuator 14 includes a primary cross member 36 and a pair of spaced, opposed arms 37 that extend rearwardly from opposite sides of the back end of the primary cross member 36. The primary cross member 36 and the arms 37 form a rearwardly opening, U shaped actuator notch 38. Each arm 37 has a back end 39 that is slightly rounded on the outside, and an inwardly projecting retaining tab 40 that extends forwardly from the back end 39. Each retaining tab 40 has a tooth shape with a rearward face 41 that slopes inwardly and forwardly from the back end 39 and a forwardly facing forward face 42 that extends from the rearward face 41 to the arm 37. The rearward face 41 slopes inwardly at an angle of about 30 to 50 degrees while the forward face 42 is substantially perpendicular to the arm 37.

A pair of spaced, opposed fingers 45 extend forwardly from opposite sides of the front end of the primary cross member 36 and are connected together at the front by a secondary cross member 46. Each finger 45 includes an outwardly facing depression 47 intermediate the primary and secondary cross members 36 and 46. The actuator 14 is made from a resilient material such plastic so that the arms 37 and fingers 45 flex inwards and rebound outward when released.

The actuator 14 fits into the interior cavity 23 of the nock body 12 with the arms 37 extending into the grooves 29 of the wings 18. The actuator 14 is movable between a rearward position, shown in FIG. 3, and a forward position, shown in FIG. 4. When the actuator 14 is in the rearward position, the protrusions 26 in the interior cavity 23 of the nock body 12 engage the depressions 47 of the fingers 45 of the actuator 14, and the actuator notch 38 is spaced rearwardly from the body notch 20 at least the length of the rearward sections 32 of the grooves 29 in the inner surfaces 28 of the wings 18. When the actuator 14 is in the rearward position the back ends 39 of the arms 37 extend to the dimples 33 in the rearward sections 32 of the grooves 29, so that the dimples 33 push the arms 37 inwards and thereby move the retaining tabs 40 to a closed position wherein the retaining tabs 40 extend inwardly of the inner surfaces 28 of the wings 18. When the retaining tabs 40 are in the closed position, the distance between the retaining tabs 40 is less than the diameter of the bowstring 21.

When arrow is shot, the bowstring 21 pushes the actuator notch 38 forward towards the body notch 20, moving the actuator 14 to the forward position. When the actuator 14 moves to the forward position, the depressions 47 of the fingers 45 of the actuator 14 move forward relative to the protrusions 26 in the interior cavity 23 of the nock body 12, and the protrusions 26 push the fingers 45 inward. The resiliency of the fingers 45 creates a rearward force and the fingers 45 therefore form a means for biasing 49 the actuator 14 towards the rearward position. Other means for biasing 49 can be used such as a spring or other configurations of resilient parts.

When the actuator 14 moves to the forward position, the back ends 39 of the arms 37 move forwardly and outwardly from the dimples 33 in the rearward sections 32 of the grooves 29 to the rearward ends of the forward sections 31 of the grooves 29, moving the retaining tabs 40 outwardly to an open position wherein the retaining tabs 40 withdraw to the inner surfaces 28 of the wings 18. When the retaining tabs 40 are in the open position, the distance between the retaining tabs 40 is greater than the diameter of the bowstring 21.

After release of the bowstring 21, when the bowstring 21 stops, the arrow continues at high velocity towards the target. The means for biasing 49 returns the actuator 14 to the rearward position which moves the retaining tabs 40 back to the closed position. The speed at which the actuator 14 moves to the rearward position is dependent upon the rearward force of the means for biasing 49. The rearward force of the means for biasing 49 is selected such that the bowstring 21 clears the retaining tabs 40 before the retaining tabs 40 return to the closed position, so that the bowstring 21 clears the arrow nock 10 without resistance. Factors that effect the rearward force of the means for biasing 49 included the thickness and resiliency of the material of the fingers 45.

The slope of the rearward faces 41 of the retaining tabs 40, combined with the resilience of the wings 18 and arms 37 allows the bowstring 21 to enter the arrow nock 10 easily when the retaining tabs 40 are in the closed position. The substantially perpendicular forward faces 42 of the retaining tabs 40 securely retains the bowstring 21 until the bowstring 21 is released.

Figure 5:
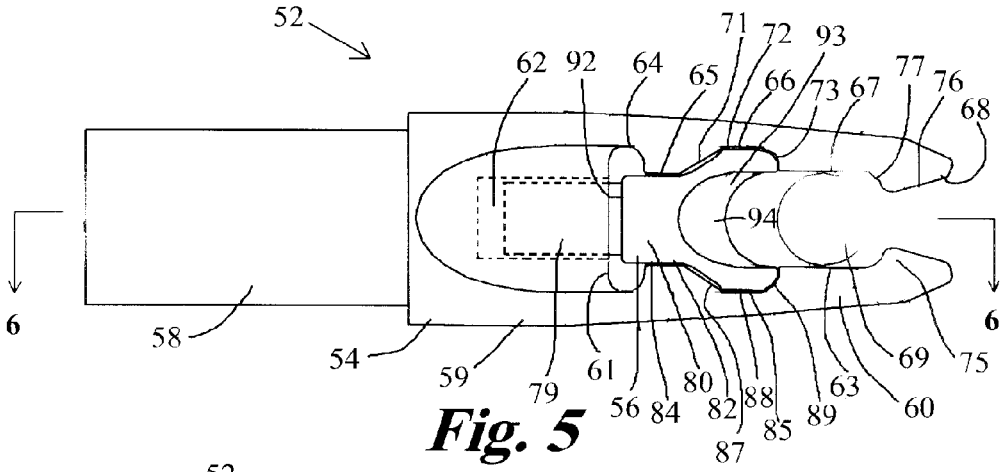
FIG. 5 is a top plan view of another arrow nock embodying features of the present invention, with the actuator in the rearward position.
Figure 6:
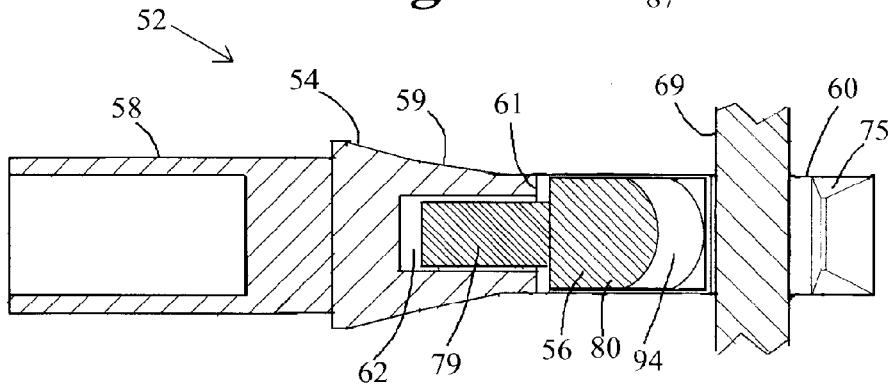
FIG. 6 is a cross sectional view of the arrow nock of FIG. 5 taken along line 6—6.
Figure 7:
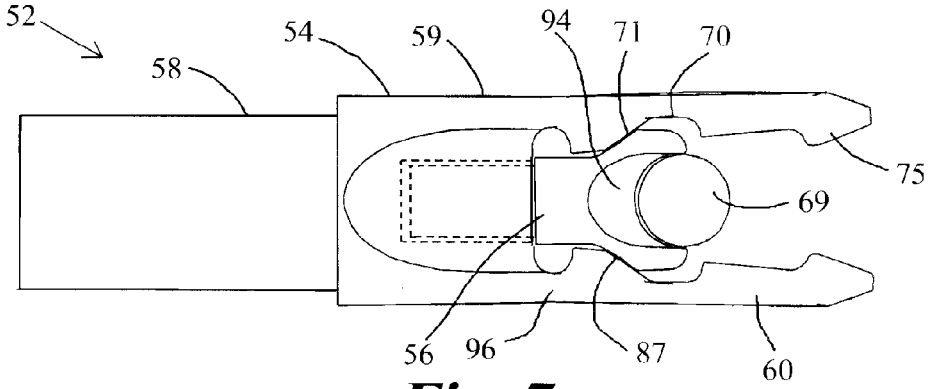
FIG. 7 is a top plan view of the arrow nock of FIG. 5, with the actuator in the forward position.

Referring now to FIGS. 5 to 7, another arrow nock 52 embodying features of the present invention includes a nock body 54 and an actuator 56. The nock body 54 is made of a resilient material such as plastic, and has a forward portion 58, an intermediate portion 59 and two wings 60. The forward portion 58 is sized and shaped to affix to the tail end of an arrow. The intermediate portion 59 extends rearwardly from the forward portion 58 to a back end 61. A cylindrical interior cavity 62 extends forwardly into the intermediate portion 59 from the back end 61. The wings 60 are spaced apart and extend substantially parallel from opposite sides of the back end 61 of the intermediate portion 59.

The wings 60 each have a shaped, substantially vertical inner surface 63. Each inner surface 63 includes a forward section 64 that extends rearwardly from the back end 61 of the intermediate portion 59, an intermediate section 65 that extends rearwardly from the forward section 64, a depression 66 that extends rearwardly from the intermediate section 65 and a rearward section 67 that extends rearwardly from the depression 66 to a back end 68. The forward section 64 has an inwardly opening, concave profile such that the wing 60 at the forward section 64 has a relatively thin width. The intermediate and rearward sections 65 and 67 are flat and coplanar. The spacing between the inner surfaces 63, at the intermediate and rearward sections 65 and 67, is selected to be greater than the diameter of the bowstring 69.

The depression 66 has an inwardly opening, concave profile, and includes a rearwardly, outwardly sloping front surface 71 connected to the intermediate section 65, a flat middle surface 72 that extends rearwardly from the front surface 71 parallel to the intermediate and rearward sections 65 and 67, and a rear surface 73 that curves inwardly from the middle surface 72 to connect to the rearward section 67. Each rearward section 67 has an inwardly projecting retaining tab 75 that extends forwardly from the back end 68. Each retaining tab 75 has a tooth shape with a rearward face 76 that slopes inwardly and forwardly from the back end 68 and a forwardly facing forward face 77 that extends from the rearward face 76 to the rearward section 67. The rearward face 76 slopes inwardly at an angle of about 30 to 50 degrees while the forward face 77 is substantially perpendicular to the rearward section 67.

The actuator 56 includes a front portion 79 connected to a rear portion 80. The front portion 79 is cylindrical, and sized and shaped to fit into and slide in the interior cavity 62 in the intermediate portion 59 of the nock body 54. The actuator 56 is movable between a rearward position, shown in FIG. 5, and a forward position, shown in FIG. 7. The rear portion 80 is sized and shaped to fit between the inner surfaces 63 of the wings 60 when the actuator 56 is in the rearward position, and has spaced, opposed outer surfaces 84 that are shaped to substantially conform with the intermediate section 65 and the depression 66 of the inner surfaces 63 of the wings 60. Each outer surface 82 has a flat forward section 84 that fits parallel to the intermediate section 65 of the inner surface 63 of the wing 60, and a protrusion 85 that fits parallel to the depression 66 of the inner surface 63 of the wing 60. Each protrusion 85 includes a front surface 87 that slopes outwardly and rearwardly from the forward section 84, a flat middle surface 88 that extends rearwardly from the front surface 87 parallel to the forward section 84, and a back surface 89 that curves inwardly from the middle surface 88.

The rear portion 80 of the actuator 56 includes a front end 92 and a back end 93. The actuator 56 fits between the wings 60 with the front portion 79 extending into the interior cavity 62 in the intermediate portion 59 of the nock body 54. When the protrusions 85 are fit into the depressions 66 of the inner surfaces 63 of the wings 60, the front end 92 of the actuator 56 is spaced rearwardly from the back end 61 of the intermediate portion 59 of the nock body 54. The back end 93 of the rear portion 80 of the actuator 56 has a saddle shape with a rearwardly opening, concave horizontal profile, and a rearwardly facing, convex vertical profile. The back end 93 of the rear portion 80 of the actuator 56 forms an actuator notch 94 sized to receive the bowstring 69.

The retaining tabs 75 are movable between a closed position, wherein the distance between the retaining tabs 75 is less than the diameter of the bowstring 69, and an open position, wherein the distance between the retaining tabs 75 is greater than the diameter of the bowstring 69. When the actuator 56 is in the rearward position, the retaining tabs 75 are in the closed position. When arrow is shot, the bowstring 69, pushing against the actuator notch 94 of the actuator 56, pushes the actuator 56 forward to the forward position. When the actuator 56 moves to the forward position, the front surfaces 87 of the protrusions 85 move forwardly on the front surfaces 71 of the depressions 66 on the inner surfaces 63, the wings 60 flex at the forward sections 64 of the inner surfaces 63 and move apart. When the wings 60 move apart, the retaining tabs 75 move to the open position.

The resiliency of the wings 60, in combination with the sloped front surfaces 87 of the protrusions 85 on the actuator 56 and/or the sloped front surfaces 71 of the depressions 66 on the inner surfaces 63 of the wings 60, creates a rearward force, biasing the actuator 56 towards the rearward position. The wings 60 and front surfaces 71 and 87 of the depressions 66 and protrusions 85, therefore form a means for biasing 96 the actuator 56 towards the rearward position. Other means for biasing 96 can be used such as a spring or other configurations of resilient parts.

After release of the bowstring 69, when the bowstring 69 stops, the arrow continues at high velocity towards the target. The means for biasing 96 returns the actuator 56 to the rearward position which allows the retaining tabs 75 to move back to the closed position. The speed at which the actuator 56 moves to the rearward position is dependent upon the rearward force of the means for biasing 96. The rearward force of the means for biasing 96 is selected such that the bowstring 69 clears the retaining tabs 75 before the retaining tabs 75 return to the closed position, so that the bowstring 69 clears the arrow nock 52 without resistance. Factors that influence the rearward force of the means for biasing 96 include the resiliency of the material of the nock body 54, the slope of at least one of front surfaces 71 and 87 of the depressions 66 and protrusions 85, and the width of the wings 60 at the forward sections 64 of the inner surfaces 63.

The slope of the rearward faces 76 of the retaining tabs 75, combined with the resilience of the wings 60 allows the bowstring 69 to enter the arrow nock 52 easily when the retaining tabs 75 are in the closed position. The substantially perpendicular forward faces 77 of the retaining tabs 75 securely retains the bowstring 69 until the bowstring 69 is released.

Although the present invention has been described with a certain degree of particularity, it is understood that the present disclosure has been made by way of example and that changes in details of structure may be made without departing from the spirit thereof.

What is claimed is:

1. A nock for an arrow for use with a bow having a bowstring, comprising:

a nock body having a forward portion for affixing to said arrow, an intermediate portion having a back end, and two wings extending rearwardly from said back end, said wings being spaced a selected distance for receiving said bowstring, a pair of spaced, opposed, inwardly projecting bowstring retaining tabs between said wings and spaced rearwardly from said back end, said retaining tabs being movable between a closed position wherein said retaining tabs are spaced apart a distance less than the diameter of said bowstring and an open position wherein said retaining tabs are spaced apart a distance greater than the diameter of said bowstring, an actuator mounted between said wings and having a rearward facing actuator notch for receiving said bowstring, said actuator being movable between a rearward position and a forward position, said actuator being linked to said retaining tabs and moving said retaining tabs to said open position when said actuator is moved to said forward position and moving said retaining tabs to said closed position when said actuator is moved to said rearward position, and means for biasing said actuator towards said rearward position, whereby said retaining tabs remain in said closed position and retain said arrow on said bowstring until said bowstring is released, and when said bowstring is released, said bowstring pushes said actuator to said forward position and said actuator moves said retaining tabs to said open position.

2. The arrow nock as set forth in claim 1 wherein:

said actuator has a pair of spaced, outwardly biased, rearwardly extending arms that form said actuator notch with said retaining tabs being mounted on said arms, and said wings of said nock body each include an inner surface with a groove shaped to receive a said arm and to push said arm inward when said actuator is in said rearward position and to allow said arm to move outward when said actuator is in said forward position.

3. The arrow nock as set forth in claim 1 wherein:

said actuator includes a pair of spaced, forwardly extending, resilient fingers that form said means for biasing, and said intermediate portion of said nock body includes an interior cavity shaped to receive said fingers and to push said fingers inward as said actuator moves to said forward position.

4. The arrow nock as set forth in claim 1 wherein:

said wings are made of a resilient material and each include a shaped inner surface, said actuator has a pair of opposed, spaced, outer surfaces shaped to fit between said inner surfaces of said wings and to push said wings outward as said actuator moves to said forward position, and each said retaining tab is mounted on a said inner surface of a said wing.

5. The arrow nock as set forth in claim 1 wherein means for biasing has a force selected such that, when said arrow is shot, said retaining tabs move to said closed position after said bowstring clears said retaining tabs.

6. The arrow nock as set forth in claim 1 wherein said retaining tabs each have a rearwardly sloped rearward face that allows said bowstring to easily enter between said wings, and a forward face, connected to said rearward face, substantially perpendicular to said wings that securely retains said bowstring between said wings.

7. A nock for an arrow for use with a bow having a bowstring, comprising:

a nock body including a forward portion for affixing to said arrow, an intermediate portion having a back end, and two wings extending rearwardly from said back end, said intermediate portion having a shaped interior cavity, said wings being spaced a selected distance for receiving said bowstring, said wings of said nock body each having an inner surface with a shaped groove, an actuator including a pair of spaced, rearwardly extending, resilient arms and a pair of spaced, forwardly extending, resilient fingers, said actuator being movable between a rearward position and a forward position, said arms each having a back end, said arms being shaped and sized to fit into said grooves, to move said back end inwards in said grooves when said actuator moves to said rearward position and to move said back end outwards in said grooves when said actuator moves to said forward position, said fingers being sized and shaped to fit into said interior cavity, flex inwardly when said actuator moves to said forward position and to bias said actuator towards said rearward position, and an inwardly projecting bowstring retaining tab on each said arm of said actuator, said retaining tabs being movable between a closed position wherein said retaining tabs are spaced apart a distance less than the diameter of said bowstring, when said actuator is in said rearward position, and an open position wherein said retaining tabs are spaced apart a distance greater than the diameter of said bowstring, when said actuator is in said forward position, whereby said retaining tabs remain in said closed position and retain said arrow on said bowstring until said bowstring is released, and when said bowstring is released, said bowstring pushes said actuator to said forward position and said actuator moves said retaining tabs to said open position.

* * * * *